US006450092B2

(12) United States Patent
Kamir et al.

(10) Patent No.: US 6,450,092 B2
(45) Date of Patent: Sep. 17, 2002

(54) METHOD OF APPLYING DOUBLE-SIDED ADHESIVE TAPE AND GRAVURE PRINTING PLATES TO GRAVURE PRINTING DRUMS

(75) Inventors: Yosef Kamir, Netanya; Serge Steinblatt, Ra'anana, both of (IL)

(73) Assignee: Creoscitex Corporation Ltd., Herzlia (IL)

( * ) Notice: Subject to any disclaimer, the term of this patent is extended or adjusted under 35 U.S.C. 154(b) by 35 days.

(21) Appl. No.: 09/765,603

(22) Filed: Jan. 22, 2001

Related U.S. Application Data

(60) Provisional application No. 60/179,491, filed on Feb. 1, 2000.

(51) Int. Cl.[7] ..... B41M 1/10; B41F 27/12

(52) U.S. Cl. ..... 101/170; 101/415.1; 101/378; 156/313

(58) Field of Search ..... 101/415.1, 375, 101/376, 378, 382.1, 383, 483, 150, 153, 170; 156/313, 249, 267, 289

(56) References Cited

U.S. PATENT DOCUMENTS 4,527,478 A 7/1985 Difflipp et al. ..... 101/415.1
4,828,641 A * 5/1989 Werther et al. ..... 101/375
6,286,427 B1 * 9/2001 Smith ..... 101/375

FOREIGN PATENT DOCUMENTS

EP 0 928 685 7/1999

* cited by examiner

*Primary Examiner*—Leslie J. Evanisko
(74) *Attorney, Agent, or Firm*—Eitan, Pearl, Latzer & Cohen-Zedek

(57) ABSTRACT

A method for applying a gravure printing plate to a gravure printing drum including applying a release liner on the gravure printing drum, wherein a release layer of the release liner faces away from the drum, applying a double-sided adhesive foil to the gravure printing drum, wherein the two edges of the adhesive foil overlap, cutting through the overlapping edges of the adhesive foil and through the release liner, removing the release liner and attaching the two cut edges of the adhesive foil to the drum, applying a release liner on the gravure printing drum, wherein a release layer of the release liner faces towards the adhesive foil, applying the gravure printing plate onto the double-sided adhesive foil, wherein the two edges of the plate overlap in the area of the release liner, cutting through the overlapping edges of the gravure printing plate and through the release liner; and removing the release liner and attaching the two cut edges of the gravure printing plate to the adhesive foil.

4 Claims, 6 Drawing Sheets

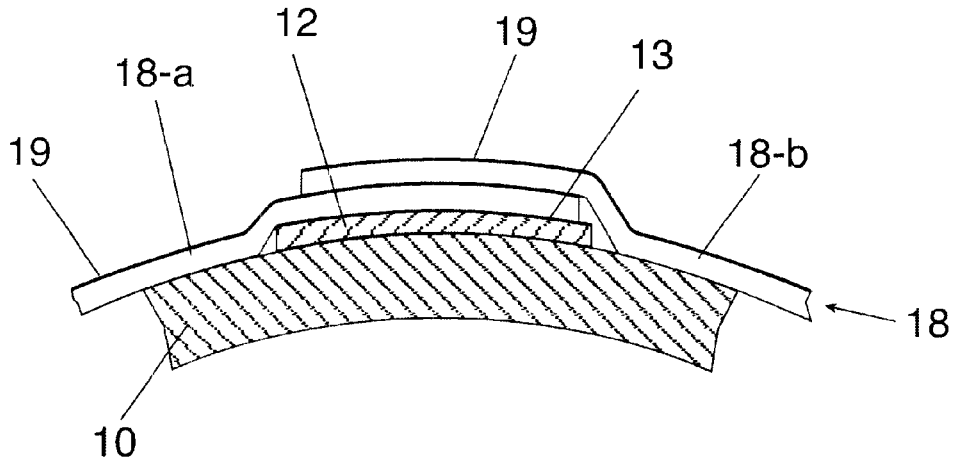
FIG. 1-A
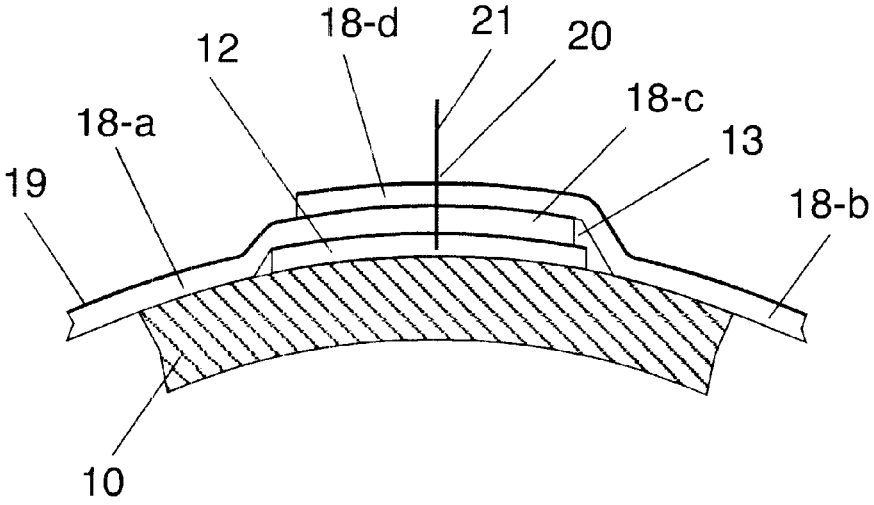
FIG. 1-B

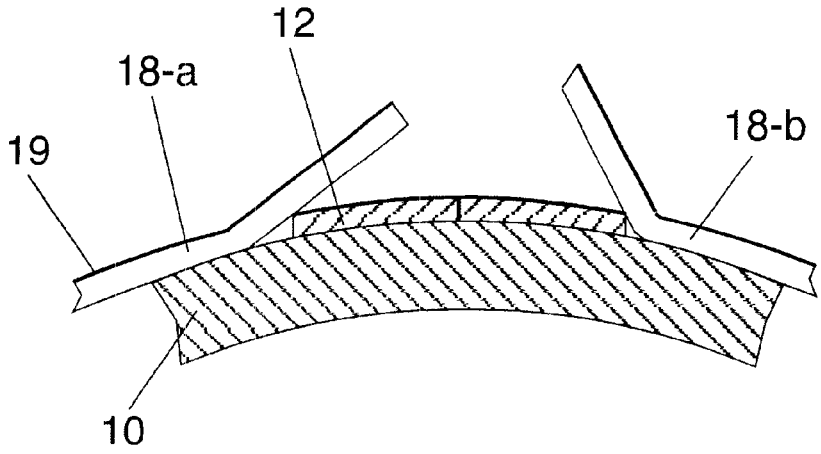
FIG. 1-C
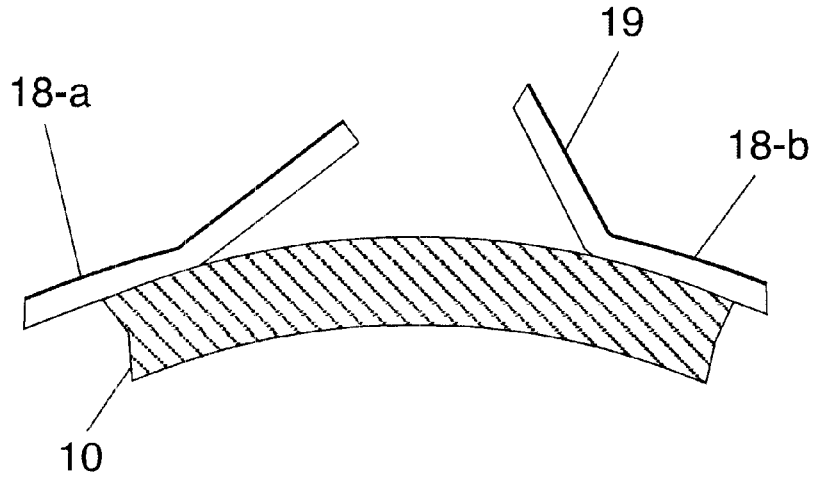
FIG. 1-D

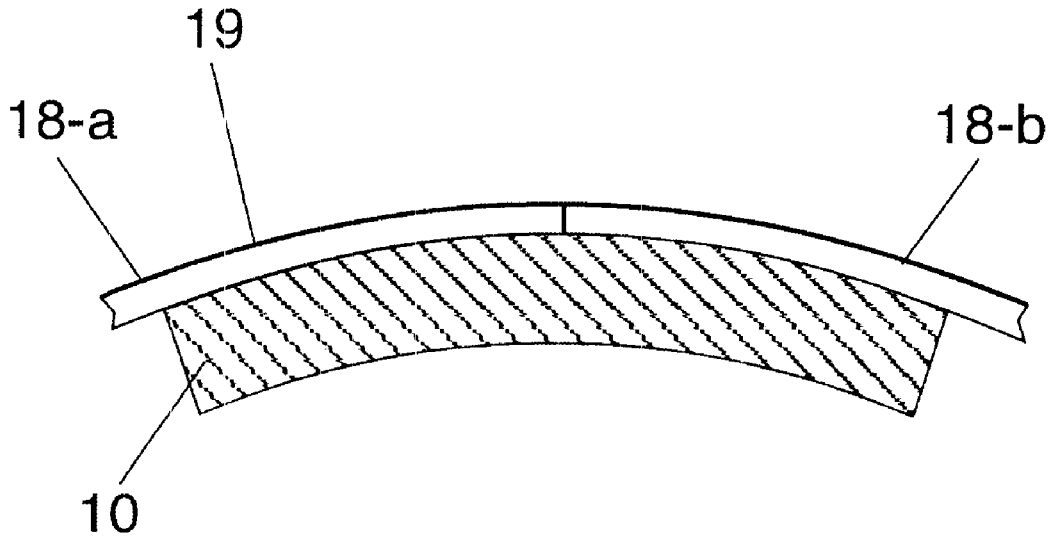
FIG. 1-E

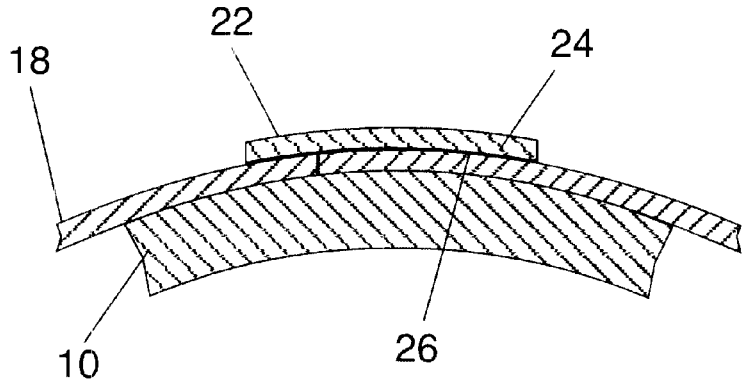
FIG. 2-A
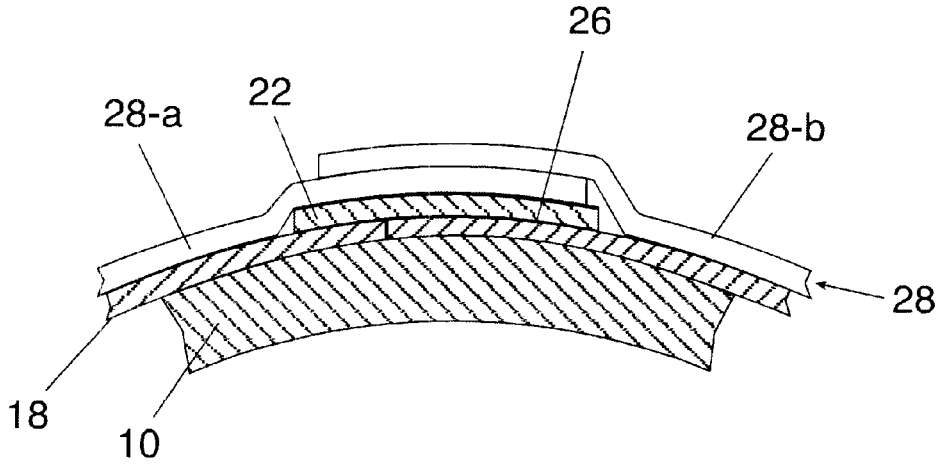
FIG. 2-B

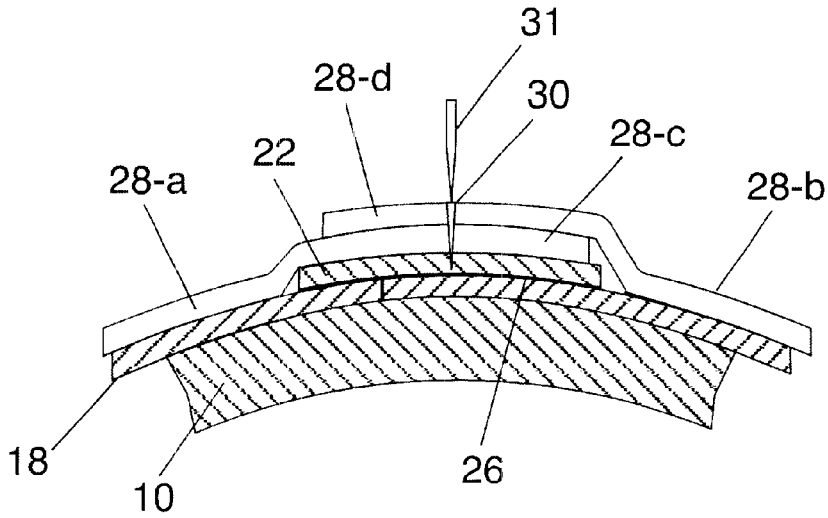
FIG. 2-C
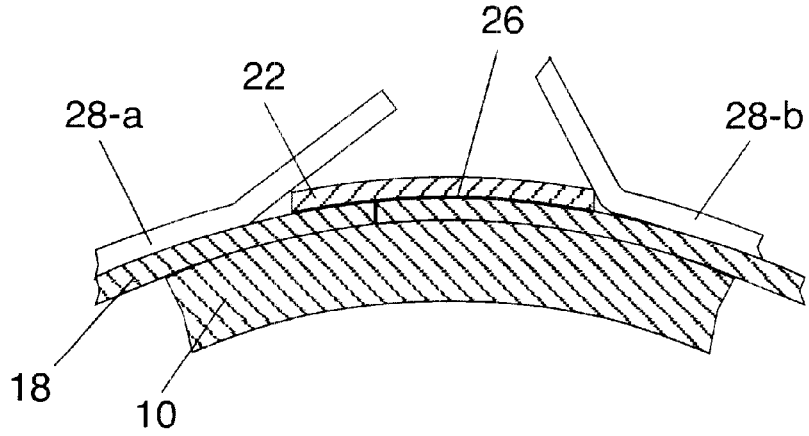
FIG. 2-D

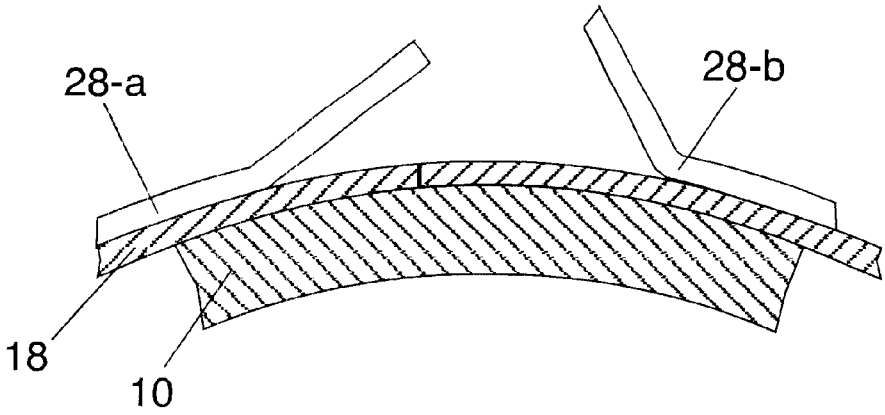
FIG. 2-E
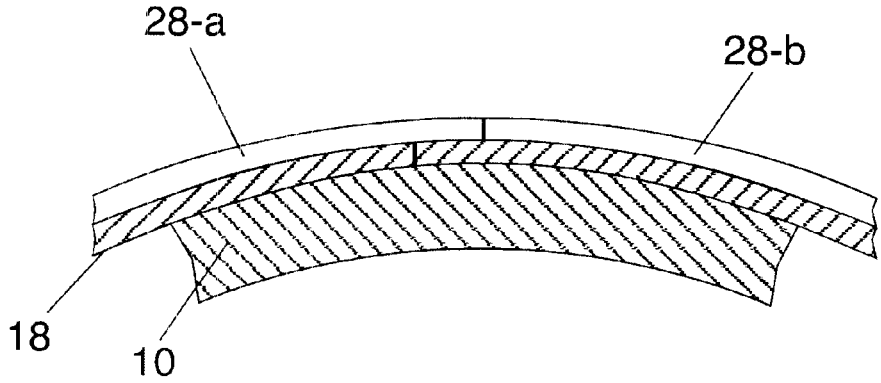
FIG. 2-F

METHOD OF APPLYING DOUBLE-SIDED ADHESIVE TAPE AND GRAVURE PRINTING PLATES TO GRAVURE PRINTING DRUMS

This application claims the benefit of U.S. provisional application No. 60/179,491, Feb. 1, 2000.

FIELD OF THE INVENTION

The present invention relates generally to gravure printing and more particularly to the application of gravure printing plates to gravure printing drums.

BACKGROUND OF THE INVENTION

Gravure printing plates are well known in the art, An example of a gravure plate is disclosed in European Patent application No. EPO. 928685 assigned to the CreoScitex Corporation Ltd. The gravure plate usually includes a substrate layer, a wash-off layer, a protective layer and an IR ablatable layer. Imaging of a gravure plate so as to create an image representing the information to be printed typically includes the following steps:

1. Exposing the protective layer to IR radiation. This step may be done, for example, by LOTEM-FLEX 40–45 manufactured by CreoScitex Corp. Ltd. of Herzlia, Israel.
2. Exposing the wash-off layer to UV radiation; and
3. Washing off the uncured wash-off layer by a solvent.

Once the process described above is completed, the gravure plate is ready to be used as a printing plate. In the printing set-up the gravure plate is attached to the drum of the gravure printing press for printing. The printing process includes application of ink to the outer surface of the gravure plate: the voids produced during the imaging process described above are filled with ink, while the surplus ink is wiped off by a closely contacting wiper, commonly known as the "doctor blade".

Because of the wiping action of the "doctor blade", the outer surface of the gravure plate must be smooth, without gaps, or seams between the butted edges, or overlap of the edges, since these may show up in the print or may catch the blade and thus peel off the printing plate.

Many mechanisms for clamping gravure plates on printing drums are known in the art, most of them based on complex mechanisms. One such mechanism is disclosed in U.S. Pat. No. 4527478.

SUMMARY OF THE INVENTION

The present invention relates to the application of gravure plates to drums of gravure printing machines, using double-sided adhesive foil. The application of the plate to the drum is done in two stages: in the first stage, the double-sided foil is applied and cut, so as to butt the two edges accurately. In the second stage, the gravure plate is applied and its edges are cut so as to butt the edges, leaving practically no gap.

BRIEF DESCRIPTION OF THE DRAWINGS

The present invention will be understood and appreciated more fully from the following detailed description taken in conjunction with the drawings, wherein corresponding or like numbers or characters indicate corresponding or like components:

FIGS. 1-A through 1-E schematically illustrate the first stage of applying a double-sided adhesive foil to the printing drum, according to the present invention; and FIGS. 2-A through 2-F schematically illustrate the second stage of applying the gravure plate onto the adhesive foil, according to the present invention.

DETAILED DESCRIPTION OF THE PRESENT INVENTION

The application of a gravure printing plate onto the printing drum according to the present invention is done in two stages:

In the first stage, the double-sided foil is applied and cut, so as to butt the two edges accurately. In the second stage, the gravure plate is applied and its edges are cut so as to butt the edges, leaving practically no gap.

Reference is made to FIG. 1-A, which schematically illustrates part of the first stage of applying a double-sided adhesive foil to the printing drum, according to the present invention. A strip of release liner 12 is laid and temporarily secured along the longitudinal axis of drum 10. with the releasing layer 13 facing upward. Such release liners, with a maximal thickness of, for example, 0.1 mm, are widely used as protective layers of adhesive tapes and are peeled from the adhesive layer prior to application of the tape. Such a release layer is, for example, One Side Siliconised Glassine, manufactured by Rierama S.p.A, Monfa, Italy.

Double-sided adhesive foil 18 is then applied to the drum 10. The upper side of the adhesive foil 18 is protected by release liner 19. The adhesive foil is applied such that its exposed adhesive side faces the drum and it's edges 18-*a* and 18-*b* cover the release liner 12 and overlap each other as shown in FIG. 1-A. Such double-sided adhesive foil is, for example, Duplocoll 310 manufactured by Lohmann GmbH & Co. KG, Neuweid, Germany.

The foil 18 is wrapped around the drum 10, using methods well known in the art.

Reference is now made to FIG. 1-B. A cut 20 is made through the layers formed by the overlapping adhesive foil edges 18-*a*, 18-*b* and the release liner 12 The cut 20 is done using a sharp knife 21. Such a knife 21 may be, for example, type L-500G manufactured by NT Inc. Osaka, Japan. The cut is preferably at an angle, such as 5° to the drum's longitudinal axis, to serve as an additional safety measure against being peeled off by the "doctor blade".

The surplus strips 18-*c* and 18-*d*, formed by the cut 20, are then disposed of, while the edges 18-*a* and 18-*b* of the adhesive foil are left attached to the drum 10.

Reference is now made to FIG. 1-C. At this stage, the edges of the adhesive foil 18-*a* and 18-*b* are raised from the release liner 12.

Reference is now made to FIG. 1-D. The strip of release liner 12 is now removed from the drum. 10.

Reference is now made to FIG. 1-E. The edges 18-*a* and 18-*b* of the foil are attached to the drum 10. As the two edges 18-*a* and 18-*b* were cut simultaneously, they are fully butted.

A technique similar to the one described above is used in the next stage, to apply the gravure plate onto the drum 10, now covered by the double-sided adhesive foil.

Reference is now made to FIG. 2-A. The release liner 19 (not shown) of FIG. 1-E is peeled off from the double-sided adhesive foil. A new strip of release liner 22 is attached to the adhesive foil 18, with its releasing side 26 facing the adhesive foil, while the substrate 24 of the release liner is facing up.

Reference is now made to FIG. 2-B. The gravure plate 28 is applied onto the adhesive foil 18, so that its first edge 28-*a* covers the release liner 22. After attaching the plate 28 to the circumference of the drum 10, using methods well known in the art, the second edge 28-*b* of the gravure plate should overlap the first edge 28-*a*.

Referring now to FIG. 2-C, a cut 30 is made along the longitudinal axis of the drum 10, by using a specially shaped knife 31. Such a knife is, for example, type BSL-2 manufactured by NT Inc. Osaka, Japan. The cut is preferably at an angle, such as 5° to the drum's longitudinal axis, to serve as an additional safety measure against being peeled off by the "doctor blade". As yet another measure of safety, the present cut is done at an offset from the previous cut, so that the butting of the plate's edges is not located exactly above the butting of the double-sided adhesive foil.

The two-surplus strips 28-*c* and 28-*d*, which were produced by the cut, are then disposed of.

Referring now to FIG. 2-D, the edges 28-*a* and 28-*b* of the plate are raised, so as to expose the release liner strip 22.

Referring now to FIG. 2-E, the release liner strip 22 is disposed of.

Referring now to FIG. 2-F, the edges 28-*a* and 28-*b* of the gravure plate are attached onto the adhesive layer 18. Since these edges were cut simultaneously, the edges butt, leaving a minimal gap of the order of 10 microns.

What is claimed is:

1. A method for applying a gravure printing plate to a gravure printing drum comprising:

applying a release liner on said gravure printing drum, wherein a release layer of said release liner faces away from said drum;

applying a double-sided adhesive foil to said gravure printing drum, wherein the two edges of said adhesive foil overlap;

cutting through said overlapping edges of said adhesive foil and through said release liner;

removing said release liner and attaching said two cut edges of said adhesive foil to said drum;

applying a release liner on said gravure printing drum, wherein a release layer of said release liner faces towards said adhesive foil;

applying said gravure printing plate onto said double-sided adhesive foil, wherein the two edges of said plate overlap in the area of said release liner;

cutting through said overlapping edges of said gravure printing plate and through said release liner; and removing said release liner and attaching said two cut edges of said gravure printing plate to said adhesive foil.

2. The method as described in claim 1, wherein said first step of cutting is done at an angle to the longitudinal axis of said drum.

3. The method as described in claim 1, wherein said second step of cutting is done at an angle to the longitudinal axis of said drum.

4. The method as described in claim 1, wherein said two cut edges of said adhesive foil and said two cut edges of said gravure plate do not overlap.

* * * * *